US005495838A

United States Patent [19]

Johnson, Jr.

[11] Patent Number: 5,495,838

[45] Date of Patent: Mar. 5, 1996

[54] COMPRESSION BRAKING SYSTEM

[75] Inventor: John L. Johnson, Jr., Brimfield, Ill.

[73] Assignee: Caterpillar Inc., Peoria, Ill.

[21] Appl. No.: 439,682

[22] Filed: May 12, 1995

[51] Int. Cl.[6] ..... F01L 13/06; F02D 13/04

[52] U.S. Cl. ..... 123/322

[58] Field of Search ..... 123/321, 322

[56] References Cited

U.S. PATENT DOCUMENTS

| | | | |
|---|---|---|---|
| 1,044,289 | 11/1912 | Taylor | 123/321 |
| 4,413,712 | 1/1984 | Mayne et al. | 123/321 |
| 4,664,070 | 5/1987 | Meistrick et al. | 123/21 |
| 4,706,624 | 11/1987 | Meistrick et al. | 123/321 |
| 4,898,128 | 2/1990 | Meneely | 123/90.12 |
| 4,996,957 | 3/1991 | Meistrick | 123/321 |
| 5,000,145 | 3/1991 | Quenneville | 123/321 |
| 5,000,146 | 3/1991 | Szucsanyi | 123/321 |
| 5,183,018 | 2/1993 | Vittorio et al. | 123/321 |
| 5,201,290 | 4/1993 | Hu | 123/321 |

*Primary Examiner*—Andrew M. Dolinar
*Attorney, Agent, or Firm*—Frank L. Hart

[57] ABSTRACT

A compression braking system is provided which controllably opens one inlet valve and one outlet valve in response to the actuation of the injector unit rocker arm. This braking system thereby is useful on four cycle engines and is of a construction which eliminates elements of heretofore utilized compression braking systems.

5 Claims, 3 Drawing Sheets

COMPRESSION BRAKING SYSTEM

TECHNICAL FIELD

The present invention relates to a compression braking system for a diesel four cycle engine.

BACKGROUND ART

Compression braking systems for diesel engines have been known for some time. One of such braking system is known in the art as a Jake Brake. Such heretofore utilized systems typically have cast iron housings bolted above the engine valve mechanisms and utilize another valve train rocker arm at a different position for actuation motion and timing. Such systems are undesirably heavy, utilize space in the engine compartment which is at a premium, and include additional elements.

The present invention overcomes the problems set forth above by integrating the braking system into various components already present in the engine system. Further, the system of this invention is more simple, easier to construct and maintain, uses less parts, and functions to controllably open more valves per cylinder. This represents a savings of labor, time, materials, natural resources and increases efficiency and effectiveness.

DISCLOSURE OF THE INVENTION

In one aspect of the invention, a compression braking system is provided for a four cycle engine. The engine has a low pressure oil supply, an oil reservoir, and a plurality of cylinders. Each cylinder has first and second normally closed engine inlet valves, first and second normally closed engine exhaust valves, an inlet bridge extending between the inlet valves and adjacent an associated inlet rocker arm and an exhaust bridge extending between the engine exhaust valves and adjacent an associated exhaust rocker arm. A cam system is associated with each inlet and exhaust rocker for controllably moving the rocker arm and the associated valves to an open position. An electronically controlled fuel injector unit has an associated fuel injection rocker arm system. A bridge connector has first and second ends and is fixedly connected at a respective end to the inlet bridge and the exhaust bridge. The inlet and exhaust bridges each are of a construction sufficient for rocking motion of the inlet and exhaust bridges relative to their associated inlet and exhaust valves. An on/off brake controlling system is connected to the low pressure oil supply A piston is positioned between the bridge connector and the associated injector unit rocker arm and is connected to the injector unit and adapted for controllably pressurizing said piston, contacting said bridge connector and moving said bridge connector and one engine inlet valve and one engine exhaust valve to an open position in response to movement of the injector unit piston by the injector unit rocker arm. A check valve is positioned between the brake controlling system and the piston.

BEST MODE FOR CARRYING OUT THE INVENTION

Figure 1:
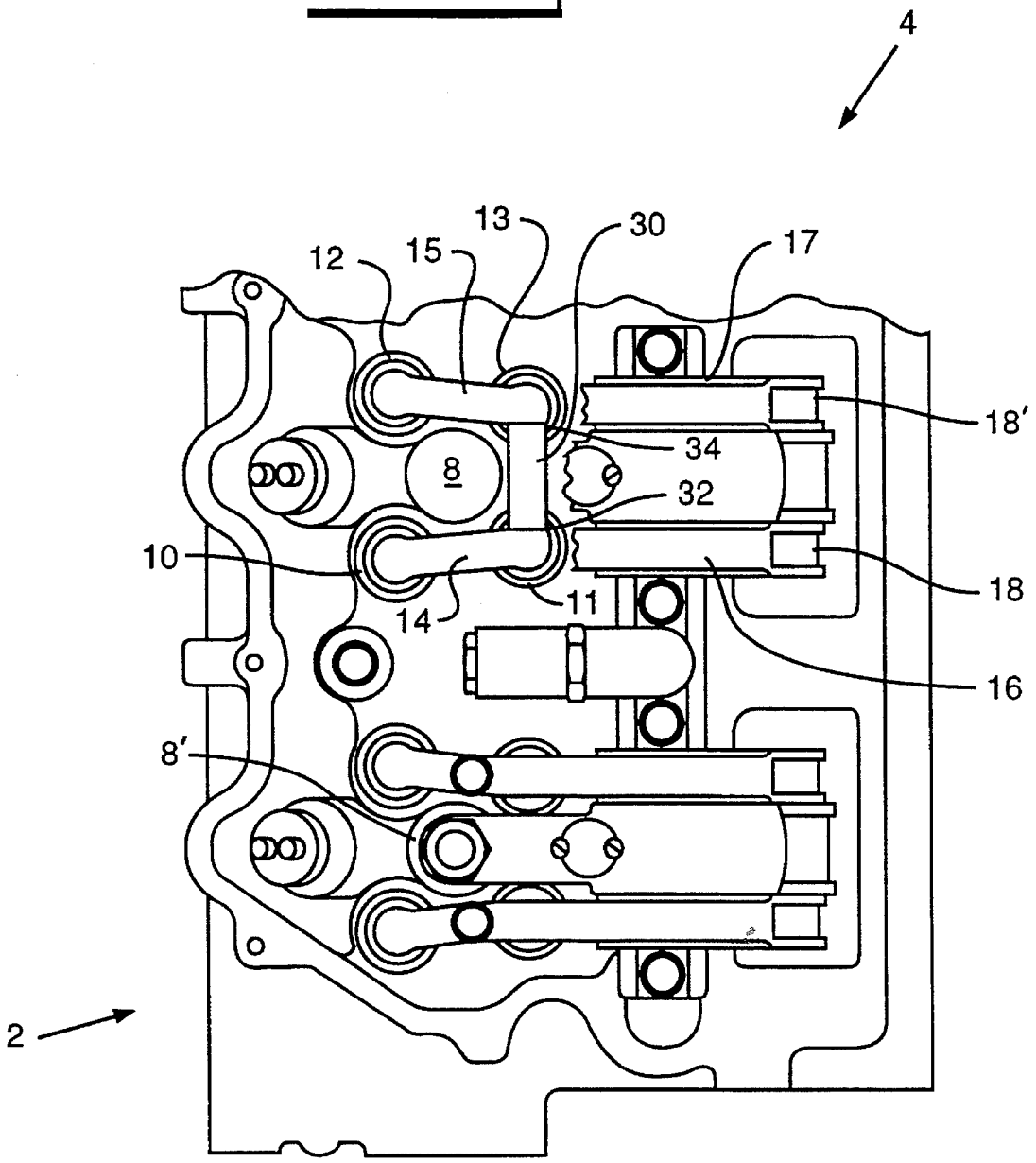
FIG. 1 is a diagrammatic top view of a portion of an engine.

Referring to the drawings, the compression braking system 2 of this invention is designed and constructed for a four cycle engine 4 that is well known in the art. Such engines 4 have an oil reservoir 6 and a plurality of cylinders 8,8'. For purposes of brevity, the subject invention will be described relative to a single cylinder 8 since each cylinder will have like compression brake elements and be associated with certain other common elements.

The cylinder 8 has first and second normally closed engine inlet valves 10,11 and first and second normally closed engine exhaust valves 12,13. An inlet bridge extends between the inlet valves 10,11 and is positioned adjacent an associated inlet rocker arm 16. An exhaust bridge 15 extends between the engine exhaust valves 12,13 and is positioned adjacent an associated exhaust rocker arm 17. A cam system 18,18' is associated with each inlet and exhaust rocker arm 16,17 for controllably moving the rocker arms 16,17 and the associated valves 10–13 to an open position. An electronically controlled fuel injector unit 19 has a plunger 20 and an associated fuel injection rocker arm system 21.

Figure 3:
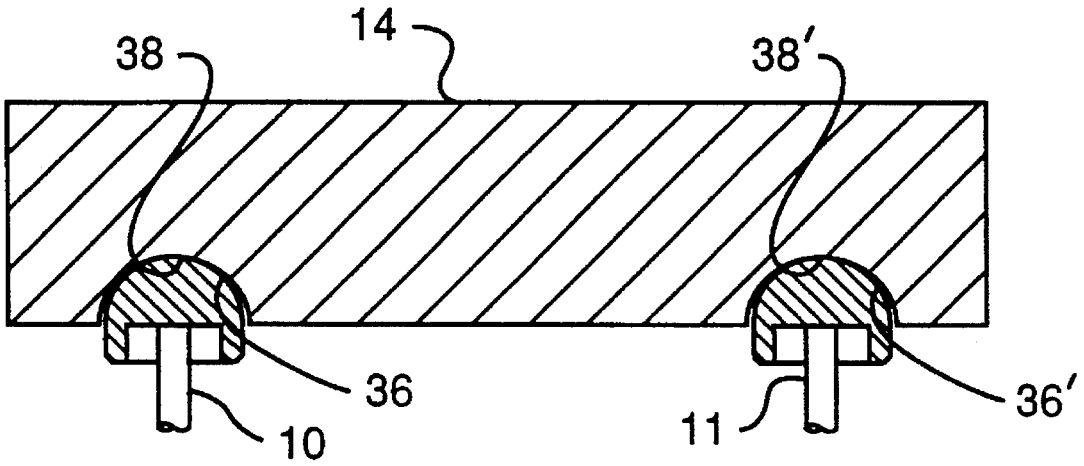
FIG. 3 is a diagrammatic side view of the bridge connecter and valve stems of the engine.

Referring to FIGS. 1 and 3, a bridge connector 30 is provided which has first and second ends 32,34 and is fixedly connected at a respective end 32/34 to the inlet bridge 14 and the exhaust bridge 15. Preferably, the inlet, exhaust and bridge connector 14,15,30 are a unitary element of general "U" configuration.

Referring to FIG. 3, the inlet and exhaust bridges 14,15 are of a construction sufficient for rocking and sliding motion of the bridges 14,15 relative to their associated inlet and exhaust valves 10–13. As can be seen, such rocking capability is provided by the stem crown 36 of the valves 10–13 being seated in a respective arcuate depression 38 formed in the inlet and exhaust bridges 14,15.

Figure 2:
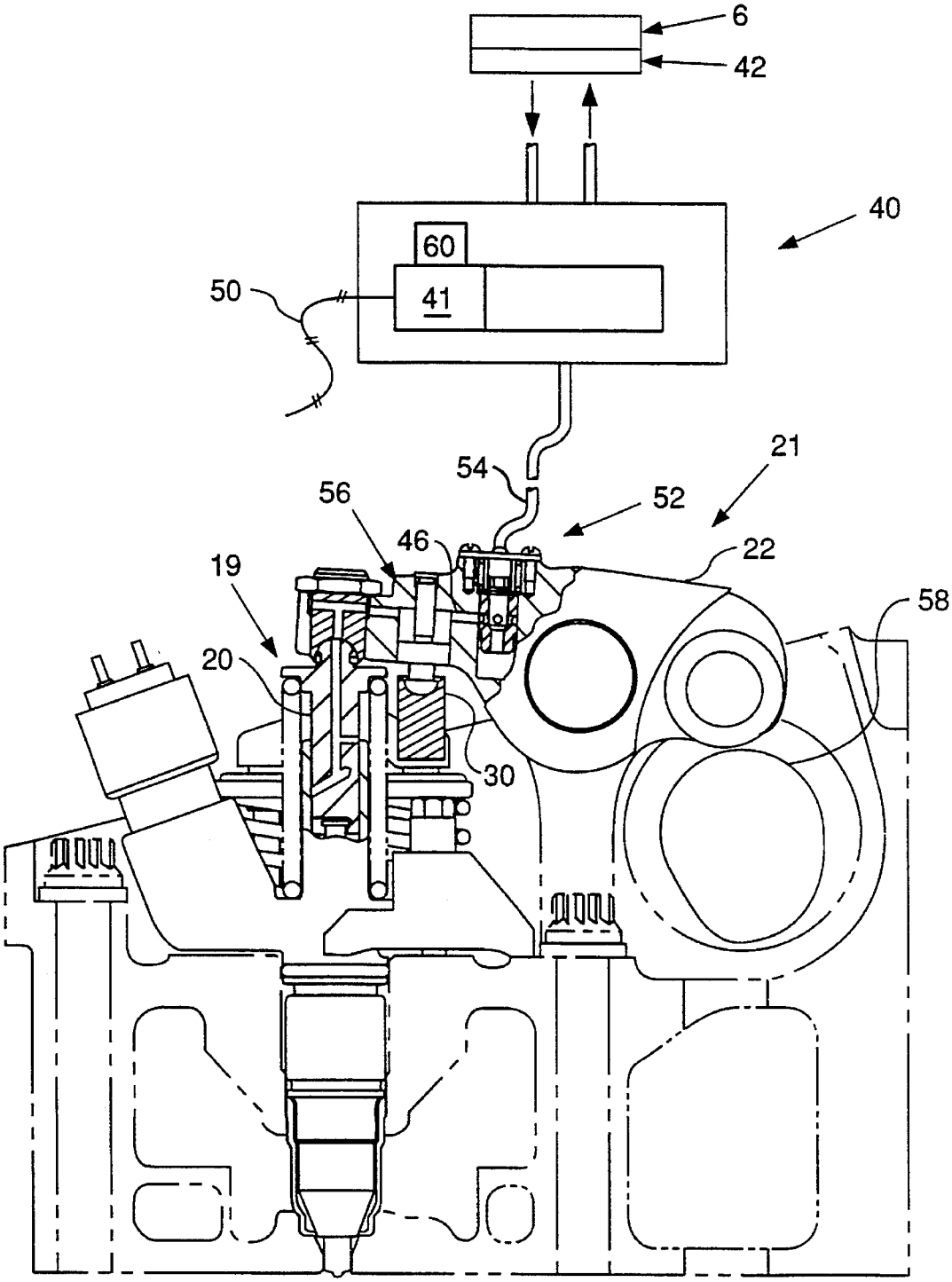
FIG. 2 is a diagrammatic view of the compression braking system of this invention.

Referring to the braking system 2 in FIG. 2, an on/of brake controlling system 40 is connected to the low pressure engine oil supply 42. The unit injector 19 is preferably electronically controlled and connected via electric line 50 to a controller 41 of the on/off brake controlling system 40 in a manner adapted to actuate the unit injector unit 19 via switch 60 in response to the brake controlling system 40 being in the off position and deactivating the injector unit 19 in response to the brake controlling system 40 being in the on position. A piston 56 is positioned between the bridge connector 30 and the associated injector unit rocker arm 22 of the injector unit rocker arm system 21. The piston is connected to the engine oil line 54.

A check valve 52 is positioned in the engine oil line 54 between the brake controlling system 40 and the injector rocker arm piston 56. An oil line extends from the piston 56 to the unit injector plunger. Bypass holes in the plunger 20 are positioned to control timing of the opening and closing of the inlet and exhaust valves.

INDUSTRIAL APPLICABILITY

In the operation of the braking system of this invention, in the off position of the controller 41, the valves 10–13 are opened and closed in the normal manner as is well known in the art. In the on position of the controller 41, the injection of fuel to the cylinder 8 is terminated in response to actuating the braking system 2. However, the injector rocker arm 22 continues to be moved by its associated injector cam 58. The piston is hydraulically extended and locked in position and motion of the injector rocker arm is transferred to the bridge connection.

The bridge connecter 30 rocks the inlet and exhaust bridges 14,15 and moves one engine inlet valve 11 and one exhaust valve 13 to their open position. As will be understood by one skilled in the art, the valves 11,13 are thereby opened near top dead center of the compression stroke or during the period when fuel would be injected if the injector unit 19 were activated. Therefore, the engine cylinder 8 is opened to the atmosphere via valves 11,13 releasing the compression energy.

By so opening the valves 11,13 the energy within the cylinder is released and is not returned to the cylinder In this manner the engine is compression braked.

Other aspects, objects and advantages of this invention can be obtained from a study of the drawings, the disclosure and the appended claims.

What is claimed is:

1. A compression braking system for a four cycle engine having a low pressure oil supply, an oil reservoir, and a plurality of cylinders, each of said cylinders having first and second normally closed engine inlet valves, first and second normally closed engine exhaust valves, an inlet bridge extending between the inlet valves and adjacent an associated inlet rocker arm, an exhaust bridge extending between the engine exhaust valves and adjacent an associated exhaust rocker arm, a cam system associated with each inlet and exhaust rocker arm for controllably moving the rocker arm and the associated valves to an open position, and an electronically controlled fuel injector unit and an associated fuel injection rocker arm system, comprising:

a bridge connector having first and second ends and being fixedly connected at a respective end to the inlet bridge and the exhaust bridge, said inlet and exhaust bridges being of a construction sufficient for rocking motion of the inlet and exhaust bridges relative to their associated inlet and exhaust valves;

an on/off brake controlling system connectable to the low pressure oil supply;

a piston positioned between the bridge connecter and the associated unit injector rocker arm and being connected to the unit injector outlet and adapted for controllably pressurizing said piston, contacting said bridge connecter and moving said bridge connector and one engine inlet valve and one engine exhaust valve to an open position in response to movement of the unit injector rocker arm; and a check valve positioned between the brake controlling system and the piston.

2. A compression braking system, as set forth in claim 1, wherein the one inlet valve and one exhaust valve are opened in response to movement of the injector rocker arm during the period when fuel would be injected if the injector unit were activated.

3. A compression braking system, as set forth in claim 1, wherein the one inlet valve and one exhaust valve are open when the associated cylinder is at and adjacent top dead center on the firing stroke.

4. A compression braking system, as set forth in claim 1, wherein the inlet, exhaust and bridge connectors are a unitary element of general "U" configuration.

5. A compression braking system, as set forth in claim 1, wherein each cylinder of the engine has a bridge connector and a piston associated with the bridge connector, said pistons each being connected to the check valve and the on/off brake controller system whereby all cylinders of the engine have compression braking capabilities.

* * * * *